US005511726A

United States Patent [19]

Greenspan et al.

[11] Patent Number: 5,511,726

[45] Date of Patent: Apr. 30, 1996

[54] NEBULIZER DEVICE

[75] Inventors: Bernard J. Greenspan, Richland, Wash.; Owen R. Moss, Cary, N.C.; Keith E. Schleiffer, Gahanna, Ohio; James L. Eick, Benton City, Wash.

[73] Assignee: Battelle Memorial Institute, Richland, Wash.

[21] Appl. No.: 95,815

[22] Filed: Feb. 23, 1993

Related U.S. Application Data

[63] Continuation-in-part of Ser. No. 823,922, Jan. 22, 1992, abandoned, which is a continuation of Ser. No. 248,558, Sep. 23, 1988, Pat. No. 5,115,971.

[51] Int. Cl.[6] ..... B05B 1/08; B05B 5/025

[52] U.S. Cl. ..... 239/102.2; 239/690

[58] Field of Search ..... 239/102.1, 102.2, 239/690, 690.1, 3; 310/339; 361/228, 235

[56] References Cited

U.S. PATENT DOCUMENTS

| | | | |
|---|---|---|---|
| 3,262,019 | 7/1966 | Maltner et al. . | |
| 3,558,903 | 1/1971 | Yamano | 310/8.7 |
| 3,790,048 | 2/1974 | Luciano et al. | 222/391 |
| 4,054,848 | 10/1977 | Akita | 310/317 |
| 4,318,062 | 3/1982 | Mitsui et al. | 310/317 |
| 4,381,533 | 4/1983 | Coffee | 361/228 |
| 4,415,101 | 11/1983 | Shapiro et al. | 222/391 |
| 4,424,720 | 1/1984 | Bucchianeri | 222/390 |
| 4,429,724 | 2/1984 | Dorros et al. | 227/390 |
| 4,431,975 | 2/1984 | Podlesny . | |
| 4,561,037 | 12/1985 | MacLaine et al. | 310/317 |
| 5,062,310 | 11/1991 | Eaton | 73/866.5 |
| 5,115,971 | 5/1992 | Greenspan et al. | 239/690 |
| 5,129,426 | 7/1992 | Boehmer | 137/854 |

*Primary Examiner*—Andres Kashnikow
*Attorney, Agent, or Firm*—Paul W. Zimmerman

[57] ABSTRACT

The present invention constitutes a portable nebulizer capable of producing a finely divided aerosol having uniformly sized droplets. The nebulizer includes a source of fluid such as a capillary tube coupled to a fluid reservoir to which a high voltage is applied in order to generate the aerosol by electrical atomization. The nebulizer further includes a piezoelectric crystal and a mechanism for deforming the crystal so as to generate the required voltage. The nebulizer further includes a means for mechanical positive displacement fluid control for controlling the amount of fluid atomized. By using electrical atomization to generate the aerosol and by piezoelectrically generating the voltage required for atomization, a nebulizer is provided which may be of small size so as to be suitable for hand-held operations, yet is capable of producing measured amounts of finely divided aerosols which are substantially monodispersed.

11 Claims, 3 Drawing Sheets

NEBULIZER DEVICE

This application is a Continuation-In-Part of application Ser. No. 07/823,922, filed Jan. 12, 1992 now abandoned, which was a continuation of Ser. No. 07/248,558, filed Sep. 23, 1988 now U.S. Pat. No. 5,115,971, issued May 26, 1992.

BACKGROUND OF THE INVENTION

The present invention relates to devices for atomizing liquids and, more particularly, to devices for producing finely divided aerosols having uniformly sized droplets.

Finely divided aerosols have generally been produced by nebulizers employing compressed air to atomize fluids. These devices operate by allowing compressed air to escape from a small orifice at the end of a tube at high velocity. The low pressure created in the exit region as a result of the Bernoulli effect causes the fluid to be atomized to be drawn out of a second tube as a thin filament which is broken up into droplets of various small sizes, thereby forming a spray, as it is accelerated in the airstream. This spray is then directed around an impaction surface on which the large droplets are preferentially deposited, and whereby some uniformity is provided with respect to droplet size. However, most nebulizers operating with compressed air have difficulty producing aerosols having particle sizes approaching one micrometer, and cannot ordinarily generate aerosols which are sufficiently uniform in size so as to be "monodispersed".

Finely divided aerosols are highly useful in many applications and particularly in administering medications which are pneumonically delivered to the patient by inhalation. Most "inhalators" used in dispensing medications are compressed air nebulizers of sufficiently small size to be suitable for hand-held use. However, in view of the characteristic limitations of such nebulizers and the further limitations inherent in the small size of most inhalators, users of these devices have had great difficulty in providing aerosols having uniform particle size, and in the related problem of providing consistent measured amounts of medication.

Difficulties include the use of environmentally harmful propellants that may affect the earth's atmospheric ozone layer. Other difficulties include formation of large droplets and streams that cause liquid to impact tissue membranes of the mouth and throat rather than form a mist that is airborne into the furthest reaches of the lung.

It is therefore an object of the present invention to provide a portable nebulizer capable of generating finely divided aerosols which are substantially monodispersed.

It is another object of the present invention to provide a nebulizer which may be small enough for hand-held use and yet provides aerosols of substantially uniform particle size while being capable of supplying medication in consistently measured dosages.

It is a further object of the present invention to provide a nebulizer which may be powered by the hand-gripping pressure of a user of the device and which is sufficiently economical to construct so as to be disposable.

SUMMARY OF THE INVENTION

The present invention comprises a portable hand-held nebulizer capable of generating aerosols characterized by uniformly sized droplets of very small dimensions by electrical atomization. A piezoelectric crystal is constructed and arranged for being mechanically deformed in accordance with pressure applied to a trigger mechanism. The crystal is adapted for generating high voltages in response to such deformations. The crystal is electrically coupled to a capillary tube and a grid element which is spaced apart from the tip of the tube. The capillary tube is connected to a reservoir of fluid to be atomized so as to allow the fluid to be supplied up to the tip of the tube. The preferred embodiment of the present invention also includes a control circuit which regulates the output of this piezoelectric crystal in order to cut off the output below and above prescribed voltage limits. Since a piezoelectric crystal will provide a voltage signal both when stressed and when stress is relieved, the voltage limits are selected to permit only one, either stress induced or stress relief, induced voltage signal to be applied to the fluid to be atomized.

In operation, the deformation of the piezoelectric crystal produces a high voltage which is transmitted to and applied across the capillary tube and grid element. The electric field existing between the tip of the tube and the grid encourages the discharge of fluid from the tube. This fluid is broken into a very large number of similarly sized droplets by the effects of the electric charges carried by the fluid and a "fan spray" aerosol is thereby formed. This process of electrical atomization furnishes an aerosol consisting of large numbers of very fine particles having a high degree of uniformity. Such aerosols are highly useful in pneumonically administering medications and in many other applications.

The nebulizer is capable of delivering precise doses of fluid. Very often the total amount of fluid must be small; for example, as small as 5 microliters. To ensure control of the total amount of delivered fluid, a mechanical positive displacement fluid delivery means is combined with the piezoelectric atomizer.

The subject matter of the present invention is particularly pointed out and distinctly claimed in the concluding portion of this specification. However, both the organization and method of operation, together with further advantages and objects thereof, may best be understood by reference to the following description taken in connection with the accompanying drawing wherein like reference characters refer to like elements.

DESCRIPTION OF THE PREFERRED EMBODIMENT

Figure 1:
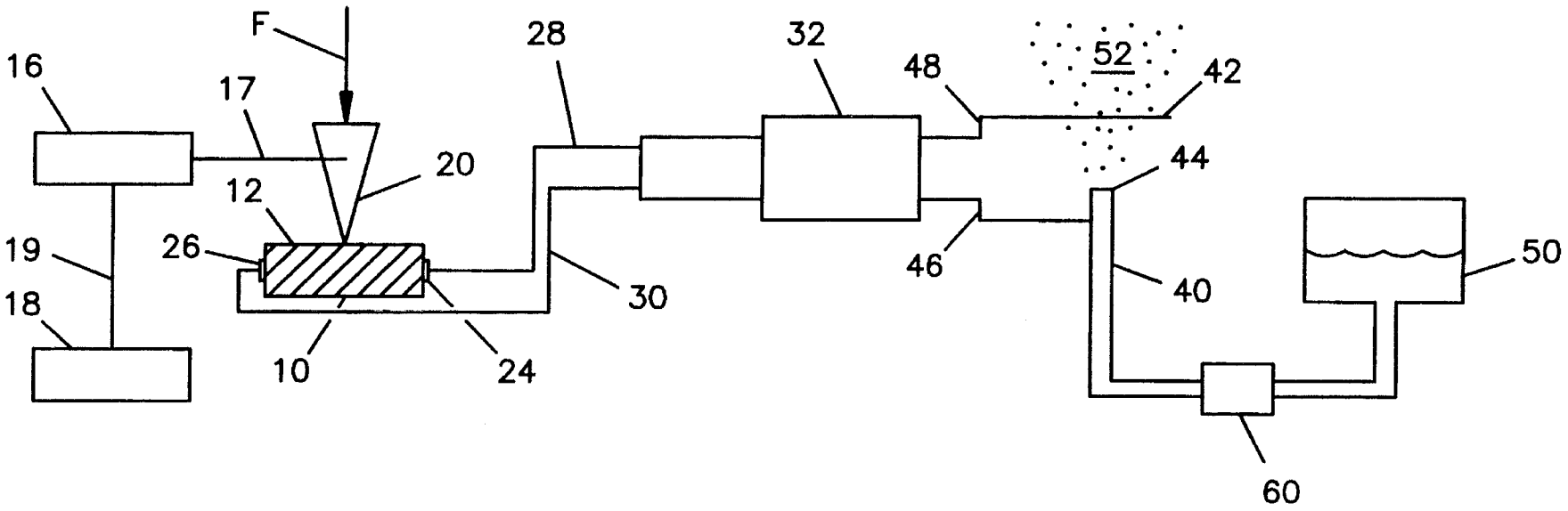
FIG. 1 is a diagrammatic view illustrating the overall system of the present invention.

Referring now to FIG. 1, the present invention comprises a nebulizer device (5) including a piezoelectric ceramic crystal (10) of a conventional type such as a lead titanate-zirconate crystal. An impact element (20) is positioned for engaging the surface (12) of the crystal (10) so that force (F) exerted on the element (20) can bend and deform the crystal (10). The rate of impact and deformation of the crystal may be slow as a squeeze, to fast as a hammer blow. The electrical contacts 24 and 26 are attached to opposite faces on the longitudinal ends of the crystal (10) for picking up electrical potentials generated across the crystal (10) by the deformation previously referred to. The conductive leads (28 and 30) transmit the voltage from the contacts (24 and 26) to the control circuit (32).

The impact element (20) is connected by a mechanical linkage to a trigger mechanism (18) which may be conveniently depressed by hand-gripping pressure exerted by a user of the device (5). The force applied by the user to the trigger mechanism (18) is multiplied by the mechanical linkage and brought to bear on the crystal (10) by the impact element (20). The linkage suitably comprises a rigid lever arm with fulcrum 16 positioned more closely to element 20 than to trigger 18 (i.e., with arm 17 being substantially shorter than arm 19). Alternatively, the mechanical linkage may comprise a rack and pinion system with the impact element (20) being driven by a cam from the pinion. Such means for multiplying force are readily understood by those skilled in the art.

The control circuit (32) is operative for regulating the voltage generated by the piezoelectric crystal (10) so that the electrical potential applied between the capillary tube (40) and grid (42) over the electrically conductive leads (46 and 48) is maintained within the range of 60–15 kV. In particular, the voltage is preferably not applied between the tube (40) and grid (42) when it is less than about 6 kV, since this may detrimentally affect the uniformity of the aerosol (52). The control circuit (32) also provides a capacitive or storing function for storing and releasing electrical charge in a well known manner so that the voltage supplied to tube 40 and grid 42 may be sustained beyond the actual period of depression of the trigger mechanism (18). The leads (46 and 48) transmit the electrical potential from the control circuit (32) to the tube (40) and grid (42). The electrical potential may be positive or negative and may be applied to either the tube (40) or the grid (42). It is preferred that the electrical potential be a positive potential and it is further preferred that the positive potential is applied to the tube (40) (and/or the fluid within the tube (40)).

The reservoir (50) contains a fluid (and more particularly a liquid) capable of being dispersed by electrical atomization techniques, such as water or ethyl alcohol, and is hydraulically connected to the capillary tube (40) so that the fluid from the reservoir (50) can flow up to the tip (44) of the tube (40). The inside diameter of the capillary tube (40) is preferably in the range of 100 to 500 microns, with its outside dimensions being as thin as possible consistent with maintaining sufficient strength and rigidity. The capillary tube (40) preferably comprises a stainless steel tube such as a No. 25 hypodermic needle, although the tube (40) may be constructed of glass or of a plastic such as tetrafluoroethylene. When tubes are used that are not electrically conductive, an electrically conductive element must be added. The electrically conductive element may be an electrically conductive coating on the tip of the tube, or it may be an electrically conductive material inserted through the tube. The fluid level in reservoir (50) should be high enough to allow the fluid to reach the tip of tube 40 by fluid flow or capillary action. Grid (42) is preferably spaced apart from about a minimum of 1.5 cm to about 2.5 cm from the tip (44) of the capillary tube (40). Greater spacing may be used with no maximum limit up to having no grid (42) at all. While FIG. 1 shows the grid (42) positioned downstream or ahead of the tip, (44) the present invention is not so limited since the grid (42) may be placed in various locations including but not limited to behind or beside the tip (44).

In operation, the user presses the trigger mechanism (18) which results in the crystal (10) being deformed as force is applied to the crystal (10) by impact element 20. The piezoelectric crystal (10) generates a voltage which may ordinarily range upward to 20 kV and may be sustained in the range of 6 to 15 kV for a period of several seconds. The exact levels of voltage generated are a function of the force applied to the trigger, and the characteristics of the mechanical linkage (16), impact element (20), and the piezoelectric crystal (10) itself. These components may be adjusted to assist in achieving the desired raw voltage output to the control circuit (32).

As previously described, the control circuit desirably regulates the output of the crystal (10) so as to limit it within the range of 6 to 15 kV, and "lengthen" the period of time during which voltage is provided. The voltage provided by the control circuit (32) is applied between the capillary tube (40) and the grid (42). The resultant electric field existing between a projection formed by the tip (44) of the tube (40), and this grid (42), causes the generation of a fan spray aerosol composed of substantially monodispersed droplets capable of exhibiting higher order Tyndall spectra. Aerosol (52) having droplets with sizes in the range of 0.2 to 5 microns can be readily produced with droplet concentration levels approaching $10^8$ particles per cubic centimeter.

The ability of the device (5) to produce a satisfactory aerosol (52) can, however, be dependent on the type of fluid which is desired to be dispersed. Fluids having either very low (e.g., benzene) or very high (e.g., inorganic acids, salts) conductivities are difficult to disperse by electrical atomization. Furthermore, other characteristics of fluids such as their dielectric constants, dipole moments, and surface tensions may affect their ability to be electrically atomized. Consequently, when medications which are dissolved in solution are desired to be dispersed, appropriate vehicles should be chosen for solvating such medications for allowing efficient atomizations.

The nature of the aerosol (52) produced by the device (5) is a complex function of the applied voltage, the size and structure of the capillary tube (40), the spacing between the tube (40) and the grid (42), the hydrostatic pressure of liquid at the tip (44) of the tube (40), and the characteristics of the liquid as previously discussed. These factors may be adjusted either individually or in combination to achieve the aerosol particle size and volume desired. In particular, the control circuit (32) is suitably used to ensure that voltage applied between the tube and grid is of consistent level and duration for aerosol generation, thereby resulting in measured dosages of medical products atomized by the device (5).

In many applications, including dispensing medications, the total amount of fluid dispensed must be precisely controlled. Another practical consideration is that many fluids are volatile, having a high vapor pressure, and can evaporate even through a small diameter capillary. Hence, for purposes of precise fluid dispensing and minimizing fluid loss through evaporation, it is desirable to decouple the user manipulation from the dispensing control. Hence, user manipulation is relied upon as an external energy source, while the control circuit (32) controls the amount of electric energy delivered to the fluid to be atomized, and a mechanical positive displacement fluid control means (60) controls the amount of fluid dispensed and atomized.

As one skilled in the art of piezoelectric control is aware, there are many control circuits that may be used. Hence, the preferred control circuit (32) described herein is exemplary and not intended to be limited to the features described.

Figure 2:
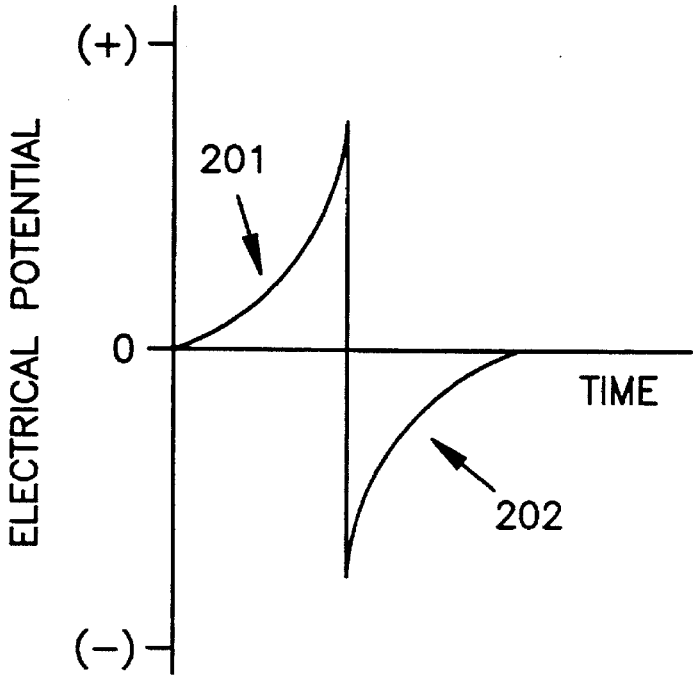
FIG. 2 illustrates the voltage output from deformation of a piezoelectric crystal.

Referring to FIG. 2, it shows a typical voltage output from deformation of a piezoelectric crystal in terms of electrical potential versus time. Two voltage signals (201 and 202) having opposite polarity are produced. Upon initial deformation of a piezoelectric crystal, a first voltage signal having a first polarity is observed, and when the crystal is allowed to relax back to its original shape, a second voltage signal having a second polarity opposite to the first polarity is observed. FIG. 2 shows the positive polarity voltage signal (201) ahead of the negative polarity voltage signal (202), but it is known that the negative polarity voltage signal (202) may be first.

There are many ways that the voltage signals (201 and 202) may be applied to create a spray of aerosol (52). One way is to select either the positive voltage signal (201) or the negative voltage signal (202), preferably the positive voltage signal (201), and charge the tube (40). Selection may be by means of a switch that is closed while the piezoelectric crystal (10) is sending the positive voltage signal (201), and is open while the piezoelectric crystal (10) is sending the negative voltage signal (202). Selection may also be made using a diode that permits only one or the other, preferably the positive voltage signal (201), to pass to the tube (40).

Figure 3:
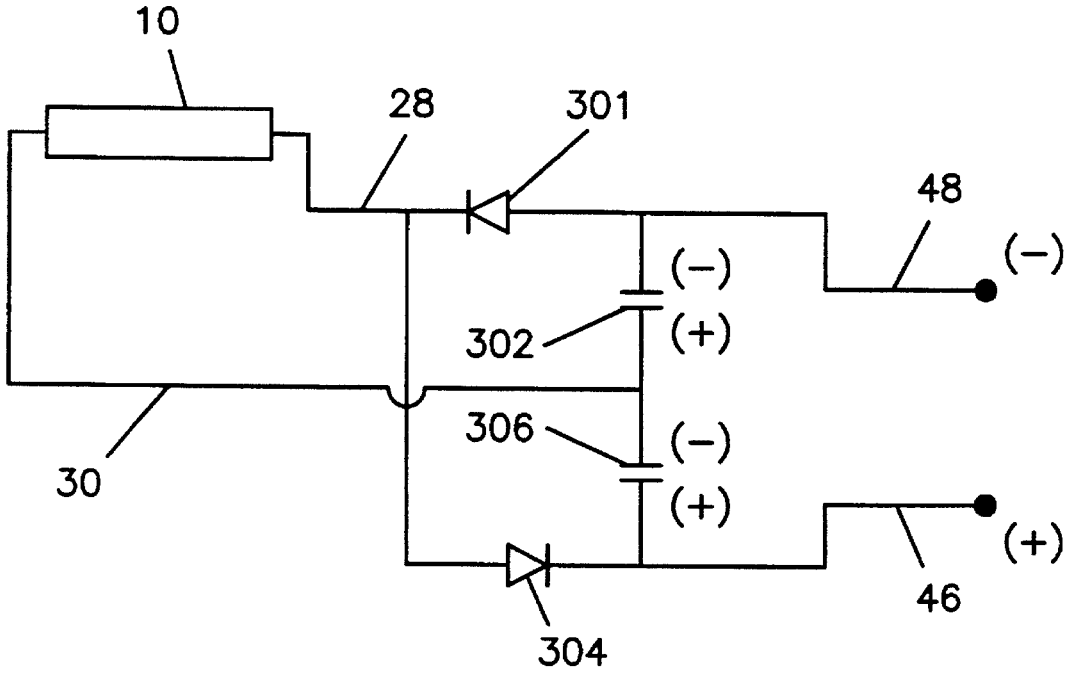
FIG. 3 is a control circuit diagram to produce the voltage output of FIG. 2.

In a most preferred embodiment, one of the voltage signals in FIG. 2 is converted so that both signals have the same polarity and may be added, thereby utilizing all of the electrical energy of the piezoelectric crystal deformation and relaxation to create a spray. In FIG. 3, a control circuit is shown that utilizes the voltage output of FIG. 2. The positive voltage signal (201) from the piezoelectric crystal (10) passes through diode 301 and charges capacitor 302. The negative voltage signal (202) passes through diode 304 and charges capacitor 306. The total potential between leads 46 and 48 is the sum of the charges in capacitors 302 and 306.

As one skilled in the art of mechanical positive displacement fluid control is aware, there are many means that may be used to accomplish positive displacement fluid control. Hence, the preferred mechanical positive displacement fluid control means described herein is exemplary and not intended to be limited to the features described.

The preferred mechanical positive displacement fluid control means (60) must be able to deliver doses from about 5 microliters to about 100 microliters with a precision and accuracy meeting applicable pharmacopeial standards. The amount of the dose depends upon the potency of the medication and the maximum amount that may be suspended or dissolved into a vehicle solution. Smaller dose volumes are preferred to minimize inhalation time and to minimize the number of user manipulations.

Accordingly, a preferred mechanical positive displacement fluid control means (60) may be a valve and, most preferably, a check valve of the type disclosed in U.S. Pat. No. 5,129,426 assigned to Vernay Laboratories, Inc., Yellow Springs, Ohio, and is hereby incorporated by reference. The Vernay valve is preferably deployed as an in-line check valve.

Another preferred check valve is disclosed in U.S. Pat. No. 5,062,310, assigned to Jade Systems, Inc., Austin, Tex., and hereby incorporated by reference. In addition to being deployed as an in-line check valve, the Jade Systems valve may be deployed as an on-off valve, or as an insertion valve. To deploy as an on-off valve, an internal or external magnet may be displaced to move an internal ball to open and close the Jade Systems valve. To deploy as an insertion valve, a capillary tube end that is placed within the Jade Systems valve is connected to means for displacing the capillary tube end toward and away from an internal sealing ball to alternately introduce and interrupt fluid flow to the capillary tip (44).

Figure 4:
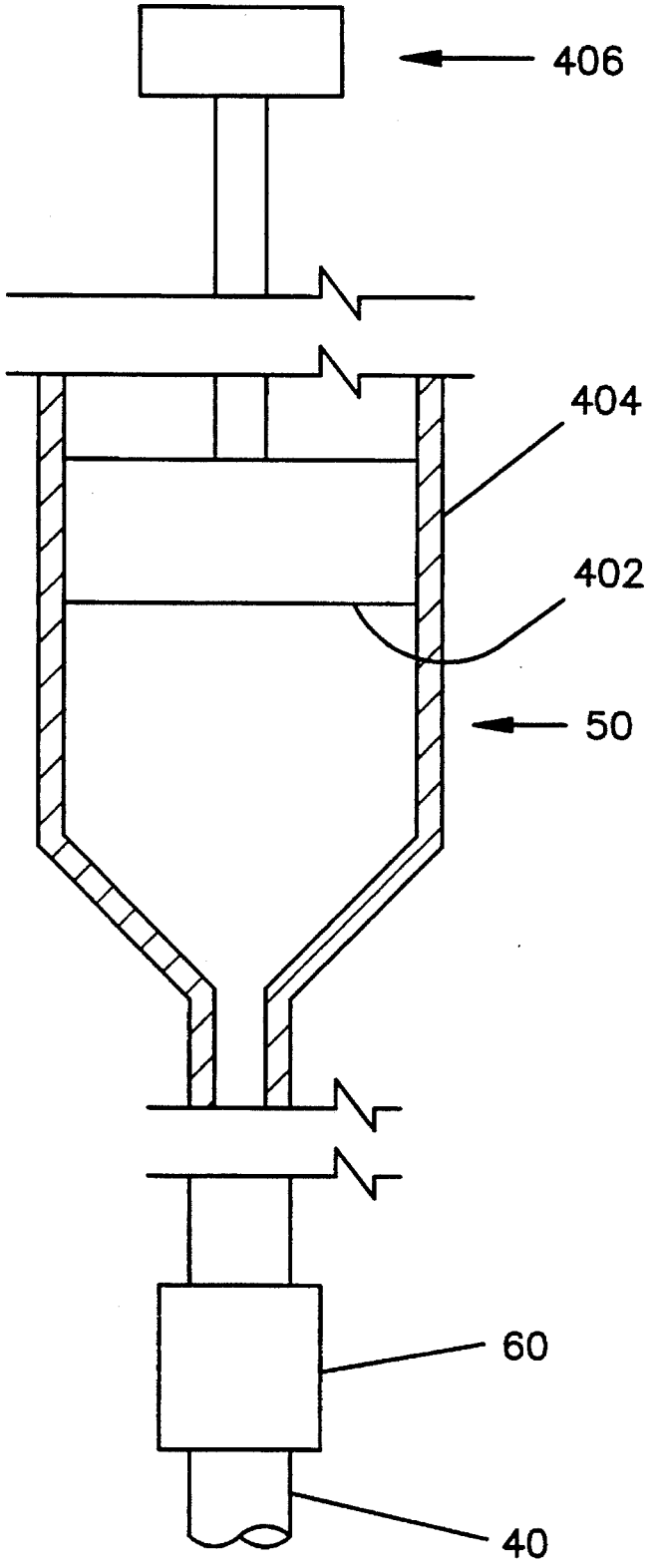
FIG. 4 is a partial cross section of a syringe pump.

In combination with a check valve, the reservoir (50) would be a syringe pump. The syringe pump (FIG. 4) has a plunger (402) within a cylinder (404) and a means (406) for controlling the plunger (402) stroke. Means for controlling plunger stroke include but are not limited to ratchet and collet. The purpose of controlling the plunger stroke is to deliver a precise amount of fluid with each crystal deformation. The plunger stroke may be controlled by any means, including but not limited to ratchets and collets.

Another preferred embodiment of a mechanical positive displacement fluid control means (60) is a miniature pump. Miniature pumps include but are not limited to micromachines, and peristaltic pumps.

While several embodiments of the present invention have been shown and described, it will be apparent to those skilled in the art that many changes and modifications may be made without departing from the invention in its broader aspects. For example, more than one capillary tube may be employed in the same nebulizer device so as to increase the volume of the aerosol produced as compared with a single-tube nebulizer device. By way of further example, the hollow capillary tube may, under suitable conditions, be replaced by another type of projection such as a short solid needle constructed and arranged so as to allow the liquid to be atomized as otherwise supplied to its tip. The appended claims are therefore intended to cover such changes and modifications as fall within the true spirit and scope of the invention.

We claim:

1. A nebulizer which is adapted for producing finely divided aerosols having uniformly sized droplets yet which may be manually powered by hand-gripping pressure, said nebulizer comprising:

(a) a piezoelectric crystal, (b) means for manually deforming said crystal so as to generate a high voltage, (c) a projection constructed and arranged for being supplied with a flow of liquid to be atomized, (d) means for applying said voltage generated by said crystal to said projection, (e) means for regulating the value of the voltage as applied to said projection, as well as for automatically controlling the duration of said application of said voltage in order to provide a predetermined dose of said liquid, and (f) means for mechanical positive displacement fluid control for controlling a total amount of liquid supplied with each crystal deformation and subsequently atomized by the projection.

2. The nebulizer as recited in claim 1, wherein said means for mechanical positive displacement comprises:

(a) a syringe pump having a plunger within a hollow cylinder and tubular outlet, (b) a plunger stroke control means, and (c) a check valve mounted on the tubular outlet.

3. The nebulizer as recited in claim 2, wherein said plunger stroke control means comprises:

(a) a ratchet.

4. The nebulizer as recited in claim 2, wherein said plunger stroke control means comprises:

(a) a collet.

5. The nebulizer as recited in claim 1, wherein said means for mechanical positive displacement fluid control comprises:

(a) a pump.

6. A nebulizer which is adapted for producing finely divided aerosols having uniformly sized droplets yet which may be manually powered by hand-gripping pressure, said nebulizer comprising:

(a) a piezoelectric crystal, (b) means for manually deforming said crystal so as to generate a first high voltage having a first polarity and permitting said crystal to relax so as to generate a second high voltage having a second polarity opposite the first polarity, (c) a projection constructed and arranged for being supplied with a flow of liquid to be atomized, and (d) a control circuit means for converting said second polarity to be the same as said first polarity, then adding the first high voltage and the second high voltage, and applying the sum of the first and second voltages to said projection.

7. A nebulizer as recited in claim 6, further comprising:

(a) means for mechanical positive displacement fluid-control for controlling a total amount of liquid supplied with each crystal deformation and subsequently atomized by the projection.

8. The nebulizer as recited in claim 7, wherein said means for mechanical positive displacement comprises:

(a) a syringe pump having a plunger within a hollow cylinder and tubular outlet, (b) a plunger stroke control means, and (c) a check valve mounted on the tubular outlet.

9. The nebulizer as recited in claim 8, wherein said plunger stroke control means comprises:

(a) a ratchet.

10. The nebulizer as recited in claim 8, wherein said plunger stroke control means comprises:

(a) a collet.

11. The nebulizer as recited in claim 7, wherein said means for mechanical positive displacement fluid control comprises:

(a) a pump.

* * * * *